United States Patent [19]

Jordi

[11] Patent Number: 4,705,408

[45] Date of Patent: Nov. 10, 1987

[54] WATCH MOUNTED ON A CLIP

[75] Inventor: Urs M. Jordi, Crans-pres-Céligny, Switzerland

[73] Assignee: Altop S.A., Geneva, Switzerland

[21] Appl. No.: 26,180

[22] Filed: Mar. 16, 1987

[30] Foreign Application Priority Data

Apr. 1, 1986 [EP] European Pat. Off. ..... 86810155

[51] Int. Cl.[4] ..... G04B 37/00; A47F 7/00

[52] U.S. Cl. ..... 368/278; 368/316; 224/903; 248/114

[58] Field of Search ..... 368/88, 276–278, 368/316–317, 10; 224/903; 24/265 WS; D10/40; 248/114–116

[56] References Cited

U.S. PATENT DOCUMENTS

| | | | |
|---|---|---|---|
| 1,466,505 | 8/1923 | Grupe | 368/316 |
| 2,181,753 | 11/1939 | Wewetzer et al. | 368/316 |
| 2,509,428 | 5/1950 | Greene | 368/316 |
| 3,312,435 | 4/1967 | Malone | 224/903 |
| 4,362,402 | 12/1982 | Kallinke et al. | 368/317 |

FOREIGN PATENT DOCUMENTS

| | | | |
|---|---|---|---|
| 3143546 | 6/1983 | Fed. Rep. of Germany | 368/316 |
| 55-61975 | 4/1982 | Japan | 368/277 |
| 169090 | 5/1939 | Switzerland | 368/316 |
| 2054274 | 2/1981 | United Kingdom | 368/316 |

*Primary Examiner*—Vit W. Miska

*Attorney, Agent, or Firm*—Gerry J. Elman

[57] ABSTRACT

The watch is mounted on the upper arm of a clip so as to be rotatable and removable. The circumference of the case of the watch is provided with ribs which co-operate with shoulders in the opening in the arm for receiving the watch. In a preferred embodiment, the ribs and the shoulders are disposed in such a manner that the watch may be removed in only one position. The watch is situated on the side of the clip which is pressed to open same.

Such a watch with a clip may be worn secured to clothes or may be placed on a surface in different positions. Due to the fact that the watch with its face may be rotated, the indicating means is extremely legible in every position.

2 Claims, 9 Drawing Figures

WATCH MOUNTED ON A CLIP

FIELD OF THE INVENTION

The present invention relates to a watch mounted on an arm of a clip so as to be rotatable and removable.

BACKGROUND OF THE INVENTION

A clock having these properties is known from No. FR-A-2 461 970. The clock described in this patent application is a relatively large table clock and has a rounded form, at least on the side opposite the time indicating means, and it is retained by magnets in a housing which may be fixed onto a branch of a clip. Due to the fact that the clock is retained in this housing by magnets, it may be rotated and removed easily. If such a method of securement can be conceivable for a relatively large and heavy table clock, it is not applicable to a small watch which may be worn either secured to clothes or secured to a chain around the neck. In addition, this known method of securement does not lend itself to a relatively cheap mass-produced product.

French Patent Application No. FR-A-2 511 165 describes a clock substantially comprising a clock body and a case in which the clock body is rotatably mounted, thereby permitting the clock to be used either as a wall clock or as a table clock. This clock is not intended to be worn secured to clothes or to a chain around the neck. Finally, German Patent Application No. DE-A-3 143 546 describes an electronic, digital watch which is disposed in a branch of a U-shaped clip and may be secured to clothes. Since the indicating means of this digital watch is fixed relative to the arm of the clip, this watch can only be secured to clothes in a single manner, to ensure that the indicating means can be easily read.

OBJECT OF THE INVENTION

Consequently, the object of this present invention is to provide a watch which is mounted on an arm of a clip so as to be rotatable and removable, can be mass-produced and at a relatively low cost and can be worn either secured to an item of clothing or secured to a chain for wearing around the neck, or can be placed oo a table.

SUMMARY OF THE INVENTION

According to the present invention there is provided in combination, a clip formed of two arms conected by a hinge means, and a watch mounted on one of said arms so as to be rotatable and removable wherein the circumference of the case of said watch is provided with ribs and wherein the upper arm of said clip includes an opening for receiving said watch, such opening being provided with shoulders for retaining said ribs and being disposed, relative to the hinge of said clip, on the end which is pressed to open same, said ribs and said shoulders being disposed so that the watch can only be removed in one single position.

BRIEF DESCRIPTION OF THE DRAWINGS

The invention will be described, by way of example, in more detail with reference to the accompanying drawings. In the drawings.

DESCRIPTION OF PREFERRED EMBODIMENTS

Figure 1:
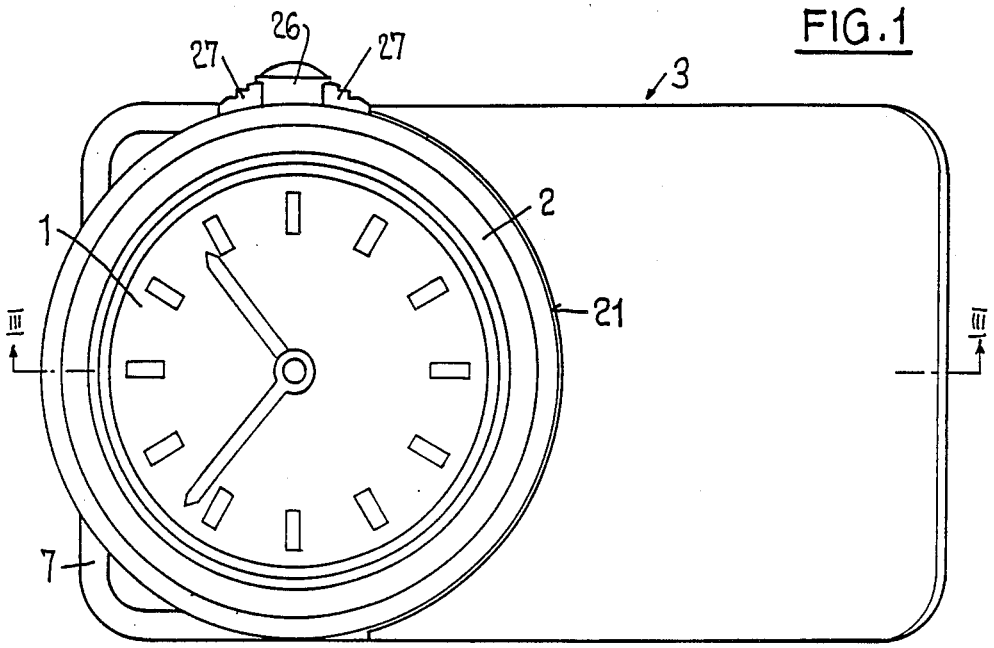
FIG. 1 is a view of the object of the invention from above.
Figure 2:
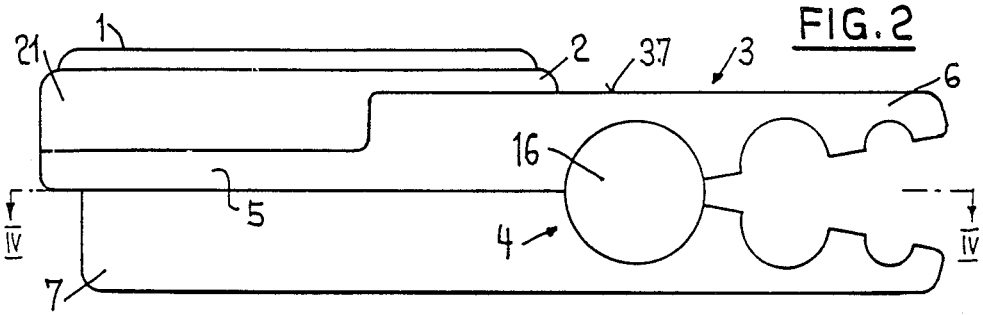
FIG. 2 is a side elevational view of FIG. 1.

FIG. 1 shows the watch 1 assembled in a case 2 and mounted in a clip 3. As regards size, the clip may have a length of 50 mm and a width of approximately 27 mm. The case and the clip are preferably moulded from plastics material. This is advantageous, on the one hand, to facilitate mass-production and, on the other hand, to obtain a watch and a clip which are very light in weight and comfortable to wear. As can be seen particularly from FIGS. 2 and 3, it should be remarked that, with regard to the hinge 4 of the clip, the watch is situated on the end where one presses on the arm 5 of the clip, and it is not situated on the gripping portion 6 of the clip. This is advantageous, in that the clip, together with the watch, may also be placed on a table, inter alia, on the lower arm 7 of the clip, so that the face of the watch is perfectly legible.

Figure 3:
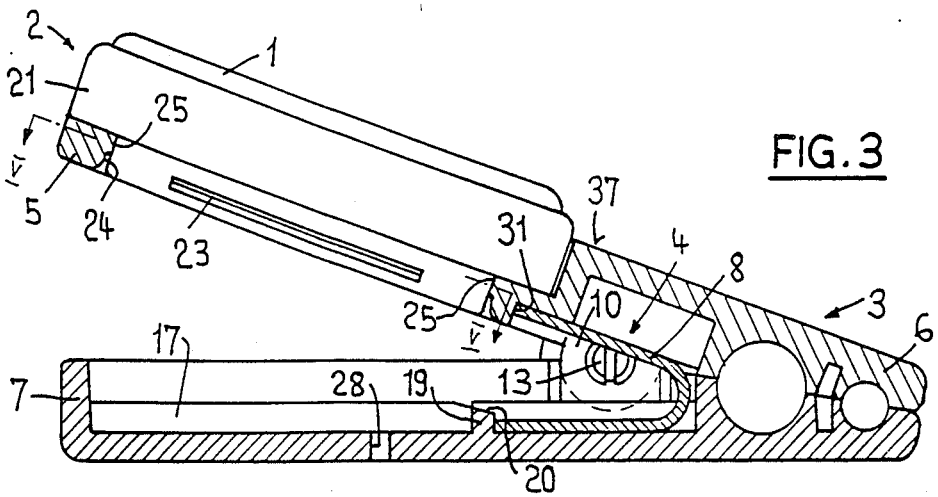
FIG. 3 is a cross-sectional view taken along the line III—III of FIG. 1.
Figure 4:
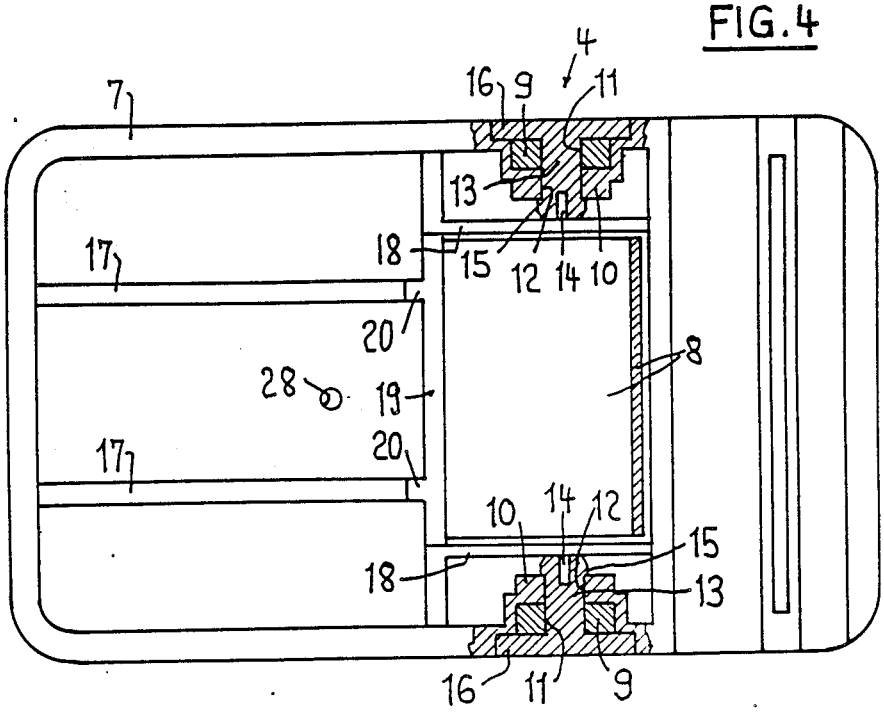
FIG. 4 is a cross-sectional view taken along the line IV—IV of FIG. 2.
Figure 5:
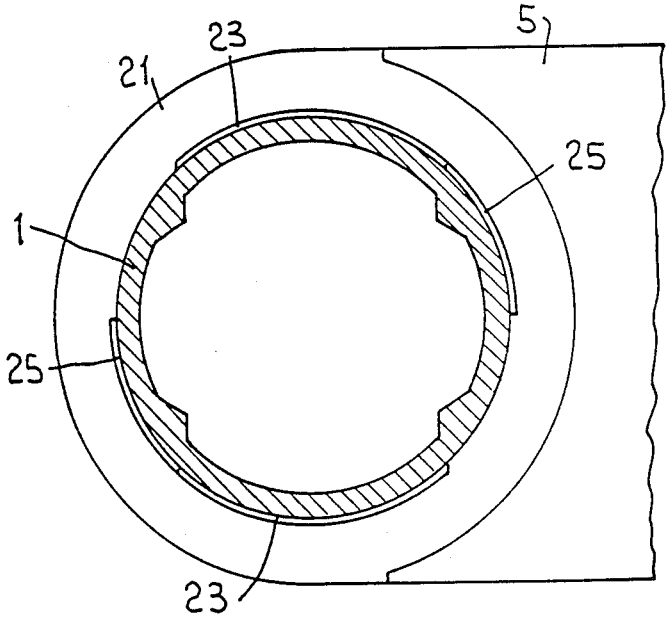
FIG. 5 is a cross-sectional view taken along the line V—V of FIG. 3.
Figure 6:
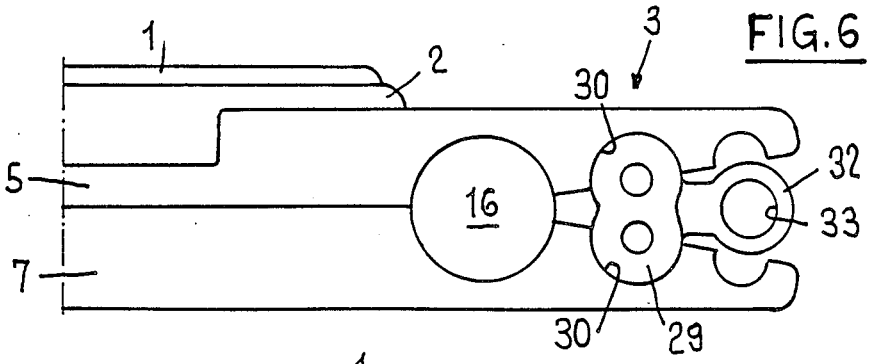
FIG. 6 shows a blocking bar in the gripping portion of the clip.
Figure 7:
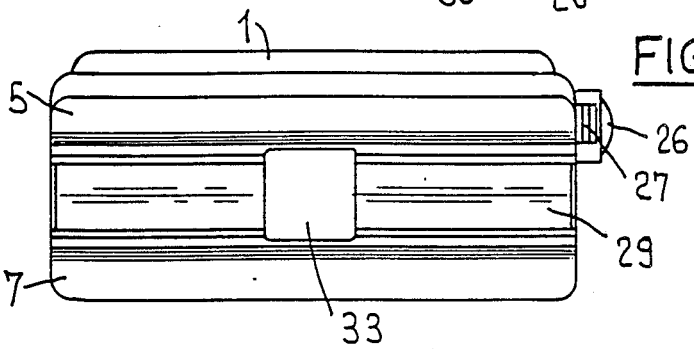
FIG. 7 shows, in detail and on a large scale, the blocking bar of FIG. 6.
Figure 8:
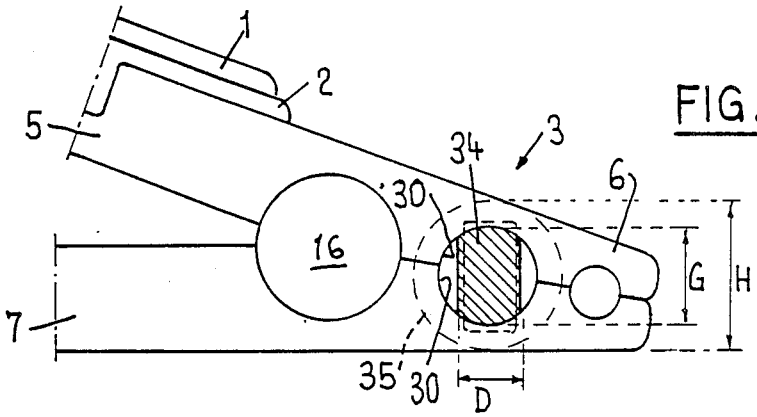
FIG. 8 shows a securing bar inserted in the gripping portion of the clip.
Figure 9:
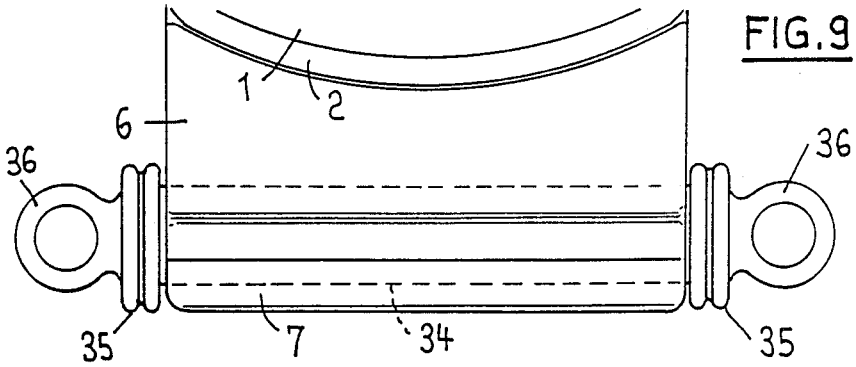
FIG. 9 is a front view of the securing bar shown in FIG. 8.

FIGS. 3 and 4 show the component parts of the clip, and it is apparent that the process for assembling this clip is extremely simple. In addition to having the upper arm 5 and the lower arm 7, the clip comprises a U-shaped leaf spring 8. On each side of the hinge 4, there is an eyelet 9 in the upper arm 5 and an eyelet 10 in the lower arm 7, the eyelet 9 being disposed near to the eyelet 10, and both eyelets having openings 11 and 12 respectively, which each accommodate a lug 13 having, on its front, inwardly orientated portion, a slot 14 for increasing the flexibility and a retaining collar 15.

The assembly process is shown in FIGS. 3 and 4. The two arms are superposed one above the other until the two openings 11 and 12 lie opposite one another, and the two lugs 13 are moved until their collar 15 is situated behind the eyelet 10. Once the lug 13 is engaged in this manner, it cannot be disengaged without destroying the lug or the eyelets. Due to the fact that the head 16 of the lug lies flush with the lateral faces of the two branches of the clip, the risk of the lugs disengaging is further reduced and, in addition, this head 16 serves as a decorative element. Once the lugs are in place, the spring 8 is inserted and, to facilitate its insertion, the inner surface of the lower arm is provided with two ribs 17. The spring 8 is held in place in the lower arm 7 by a frame comprising two lateral walls 18 and a transverse wall 19, and the spring 8 is held in place in the inner surface of the upper arm 5 by a lateral wall 31. To facilitate insertion of the spring, the surface 20 of the transverse wall 19 may be biassed.

The watch 1 is situated in a case 2 comprising an upper ring 21 and a lower ring 22. The lower ring 22 is provided with two ribs 23 which are disposed opposite one another, each rib extending over approximately one quarter of the circumference and being inserted into a corresponding opening 24 in the upper branch of the clip, this opening being provided with two shoulders 25 which have a length which is almost equal to that of the ribs 23. The ribs, on the one hand, and the shoulders, on the other hand, are disposed in such a manner that the watch, together with the case, can only be inserted or removed in only one specific position, for example, in the 14·10 position. It is, of course, possible for any other position to be specified. To protect the rim 26, it is preferable to provide a protection means 27 with grooves which permit the watch to be easily rotated with the help of this protection means. As is apparent from FIG. 2, the watch with its case does not greatly exceed the surface 37 of the upper arm which is stepped.

The watch in combination with the clip, may be secured by different methods so that it can be worn. A first method is to secure the lower arm 7 to the lapel of a jacket by means of a pin which extends through the hole 28 provided for such securement. Securement of the pin may be ensured by a pin locking means. A second method of securement is, of course, to secure the clip with the watch to any object which is suitable for attachment, for example, to clothes, a handbag or similar objects, with the help of the gripping portion 6 of the clip. It is clear that, depending, on the method of securement, the watch may be rotated in such a manner that the face, that is to say the indicating means of the watch, can be easily read. Another, additional method of securement is illustrated in FIGS. 6 to 9. According the FIGS. 6 and 7, it is possible to provide a blocking bar 29 with an extended, figure of "8" cross-section, this blocking bar being inserted sideways into the two semi circles 30 provided in the two arms of the clip. The blocking bar is provided, in its central portion, with a loop 32 having a transverse opening 33. When the watch, that is to say the clip, is provided with this blocking bar, it can easily be transported and put in a pocket just as it is, because the entire clip is in the form of a rectangular parallelepiped structure. As is apparent from FIG. 6, the length of the loop is such that it does not exceed the front of the clip. It is also possible to thread a chain or a similar item through the transverse opening and to transport the watch with the help of this chain, for example around the neck, or as a pocket watch. Due to the fact that the clip is fully open and the blocking bar is provided with flanges, this blocking bar cannot be easily disengaged, and it is practically impossible to wrench it from the front without noticing it.

Another method of securement is provided by the use of a securing bar 34 which has an extended cross-section of such dimensions that the bar can only be inserted from the front with the help of the small diameter D, while the large diameter G is identical to the diameter of the two semi-circles 30 of the clip in its closed position. Consequently, the securing bar may rotate freely in this opening and can only be disengaged when it is in a specific position. On both sides and externally of the clip, the securing bar is provided with a securement portion having a collar 35 with an outer diameter equal to the height of the closed clip and being provided with an eyelet 36 for receiving a small chain or similar item.

It is apparent from the description that the watch with the clip may also be placed by different means on a surface, for example a table, that is to say either on the lower arm or on the two ends of the arms, or alternatively on the lateral sides of the two arms. This is possible because of the facility of being able to rotate the watch with the case freely in the upper arm of the clip. Finally, it is possible to remove the watch and replace it by other object, for example by a jewel. It is also particularly apparent from FIG. 1 that the upper surface, comprising the face of the watch and the surface of the upper arm of the clip, is highly appropriate for being decorated by different methods or to serve as a surface for advertising purposes. Neither the above-mentioned dimensions, nor the components are limiting within the scope of this invention. It is entirely possible to envisage, for example, watches and clips of smaller dimensions and to manufacture them, for example, entirely of metal, even precious metal, or alternatively to envisage watches and clips of larger dimensions which may be items of fashion or advertising. It is clear that the movement and the indicating means are not limited to an analogue-type indicating means, but it is also possible to envisage digital watches or analogue-cum-digital watches which can be adjusted so that they sre perfectly visible in every desired position.

I claim:

1. In combination, a clip formed of two arms connected by a hinge means, and a watch having a generally circular case mounted on one of said arms so as to be rotatable and removable, wherein the circumference of the case of said watch is provided with ribs and wherein the upper arm of said clip includes an opening for receiving said watch, such opening being provided with shoulders for retaining said ribs and being disposed, relative to the hinge of said clip, on the end which is pressed to open same, each of said arms having a portion thereof adapted for gripping in opposing relation to the other arm, each of said gripping portions being provided with a transverse concavity that is generally semi-circular in cross section, additionally including a blocking bar with an extended figure of eight cross-section which can be inserted into said transverse concavities provided in the gripping portion of the clip, the bar being provided, in its central portion with a loop which is orientated towards one side with a transverse opening for receiving a small chain.

2. In combination, a clip formed of two arms connected by a hinge means, and a watch having a generally circular case mounted on one of said arms so as to be rotatable and removable, wherein the circumference of the case of said watch is provided with ribs and wherein the upper arm of said clip includes an opening for receiving said watch, such opening being provided with shoulders for retaining said ribs and being disposed, relative to the hinge of said clip, on the end which is pressed to open same, each of said arms having a portion thereof adapted for gripping in opposing relation to the other arm, each of said gripping portions being provided with a transverse concavity that is generally semi-circular in cross section, additionally including a securing bar having an extended cross-section, with a large diameter approximately equal to the diameter of the opening formed by said transverse concavities provided in the gripping portion of the clip, and being provided, on both sides and externally of the clip, with a securing portion having a collar and an eyelet for receiving a small chain.

* * * * *